United States Patent [19]

Viehe

[11] 3,989,170

[45] Nov. 2, 1976

[54] SELF-PRESSURIZED PORTABLE CONTAINER FOR LIQUIDS

[75] Inventor: John S. Viehe, Somerville, N.J.

[73] Assignee: World Products Merchandising Corporation, Ramsey, N.J.

[22] Filed: June 30, 1975

[21] Appl. No.: 591,521

Related U.S. Application Data

[63] Continuation-in-part of Ser. No. 553,095, Feb. 26, 1975, Pat. No. 3,929,362.

[52] U.S. Cl. ..... 222/212; 222/215

[51] Int. Cl.[2] ..... B65D 37/00

[58] Field of Search ..... 222/206, 210, 212, 215, 222/105, 386.5; 220/85 B

[56] References Cited

UNITED STATES PATENTS

| | | | |
|---|---|---|---|
| 3,722,756 | 3/1973 | Cramer, Jr. | 222/212 |
| 3,895,742 | 7/1975 | Willbern | 222/212 X |

FOREIGN PATENTS OR APPLICATIONS

| | | | |
|---|---|---|---|
| 111,198 | 5/1965 | Netherlands | 220/85 B |

*Primary Examiner*—Robert B. Reeves
*Assistant Examiner*—Charles A. Marmor
*Attorney, Agent, or Firm*—Jacob B. Burke

[57] ABSTRACT

This portable container for liquids includes a bottom ring plate on which is nested an upper pressure plate. An elastic membrane overlays the pressure plate to define therewith a chamber for containing a liquid under pressure. The membrane has a circumferential side wall abutting a side wall of the pressure plate, and an inturned wall section engaged between side walls of the ring plate and pressure plate. A nipple having a threaded axial bore opening into the chamber is integral with the pressure plate and extends downwardly through a central hole in the ring plate. A fitting having an externally threaded shank is engaged in the threaded bore of the nipple. The fitting has a radially extending other nipple on which is secured a flexible tube for passing liquid under pressure into and out of the chamber while the membrane expands and contracts. The fitting may have a radially extending head abutting a flange which is integral with the ring plate and surrounds the central hole, to hold the assembly together. Alternatively, the nipple of the pressure plate can be externally threaded and a nut can be screwed in this nipple to about the ring plate and hold the assembly together. The fitting may then have an annular flange abutting the nut to lock the fitting and nut in place.

10 Claims, 12 Drawing Figures

FIG.3.
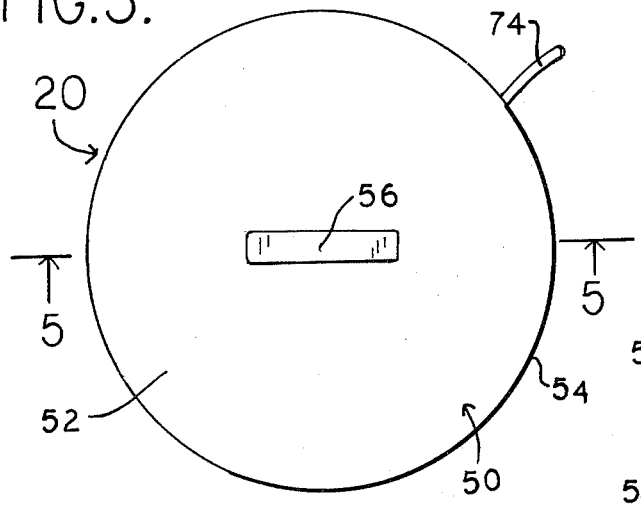
FIG.8.
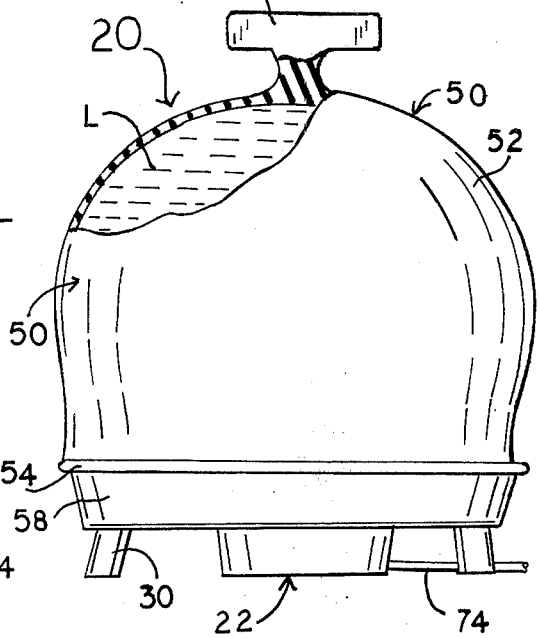
FIG. 2.
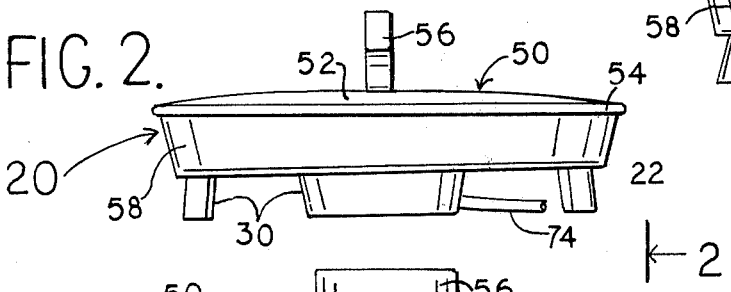
FIG.1.
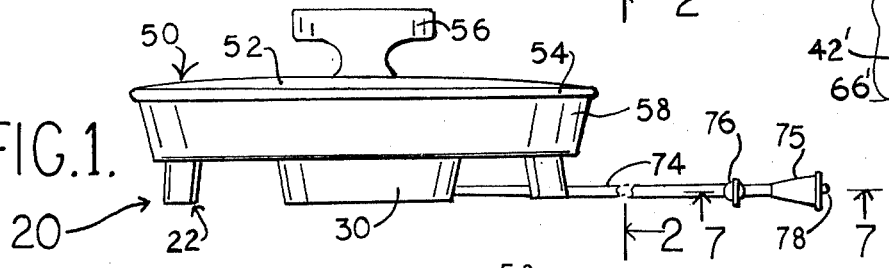
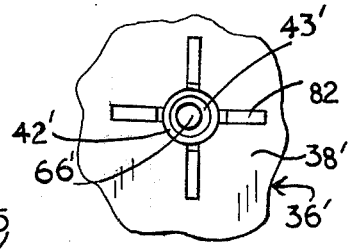
FIG.11.
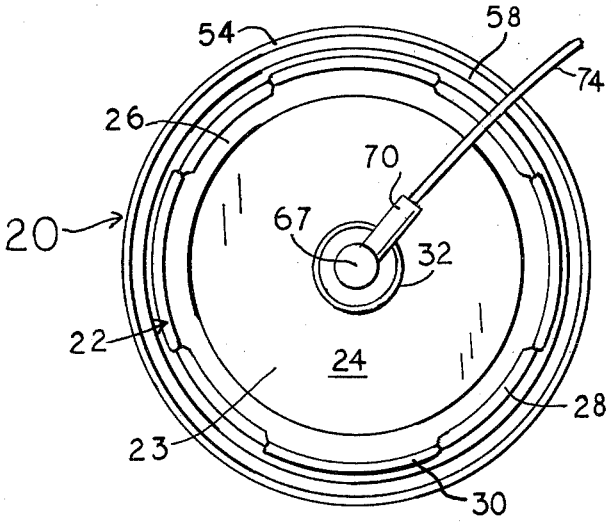
FIG.4.
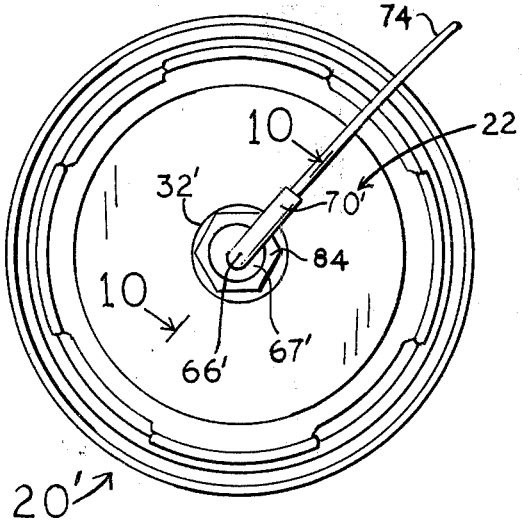
FIG.9.

20
21
22
23
24
25
26
27
28
30
32
36
37
38
39
40
42
43
50
51
52
54
56
58
60
62
63
64
66
67
68
70
72
73
74
75
76
78
79
80
82
84
11

SELF-PRESSURIZED PORTABLE CONTAINER FOR LIQUIDS

This application is a continuation-in-part of my copending U.S. patent application entitled "Self-Pressurized Portable Container for Liquids", Ser. No. 553,095, filed Feb. 26, 1975, which issued as U.S. Pat. No. 3,929,262 on Dec. 30, 1975.

This invention concerns an improved self-pressurized portable container for liquids. The invention involves improvements over prior portable containers, especially the containers described in my copending U.S. patent application for "Self-Pressurized Container for Liquids", Ser. No. 464,695, filed Apr. 26, 1974, which issued as U.S. Pat. No. 3,880,323 on Apr. 29, 1975, and the above mentioned patent.

The container described in my patent application Ser. No. 464,695, now U.S. Pat. No. 3,880,323, has an elastic membrane formed with a peripheral wall secured under tension by an adjustable clamp to the periphery of a base plate. The container is supported by cords which engage a separate handle. The cords pass through a guide plate centered over the membrane. A tape engaged with the handle and guide plate restricts twisting of the cords. Liquid is passed into and out of the chamber defined by the membrane and base plate via a nipple integral with the base plate.

The container described in patent application Ser. No. 553,095, now U.S. Pat. No. 3,929,262, is improved by providing a massive handle integrally molded with the elastic membrane. The container further includes a bowed pressure plate which is secured by a plurality of nuts and integrally formed bolts to a sealing ring plate. A fitting integrally molded with the pressure plate extends through a central hole in the ring plate. The peripheral wall of the membrane is locked between nesting annular walls of the pressure plate and ring plate.

In the present invention, the container is further improved by providing a threaded fitting which screws into a central nipple integrally formed with the pressure plate. The fitting bears against the sealing ring plate and serves to hold the assembly together. The container has a reduced number of parts making it less expensive to manufacture, easier to assemble and disassemble. In a modification of the invention a nut is screwed on the central nipple which is externally threaded. This nut bears against the sealing ring plate, and the threaded fitting is formed with a flange which bears against the nut locking it in place. The new container construction insures more uniform diffusion of forces around the periphery of the membrane gripped between the pressure plate and the sealing ring plate.

Other and further features, objects and advantages of the invention will become apparent from the following detailed description taken together with the drawing, wherein:

FIG. 1 is a front elevational view of a portable container embodying the invention, with membrane shown in contracted position.

FIG. 2 is a side elevational view of the container taken on line 2—2 of FIG. 1.

FIG. 3 is a top plan view of the container.

FIG. 4 is a bottom plan view of the container.

FIG. 8 is a front elevational view similar to FIG. 1 showing the elastic membrane expanded by liquid filling the container.

FIG. 9 is a bottom plan view similar to FIG. 4, of another container embodying another form of the invention.

FIG. 11 is a fragmentary horizontal sectional view taken on line 11—11 of FIG. 10.

Figures 5, 6, 7, 10, 12:
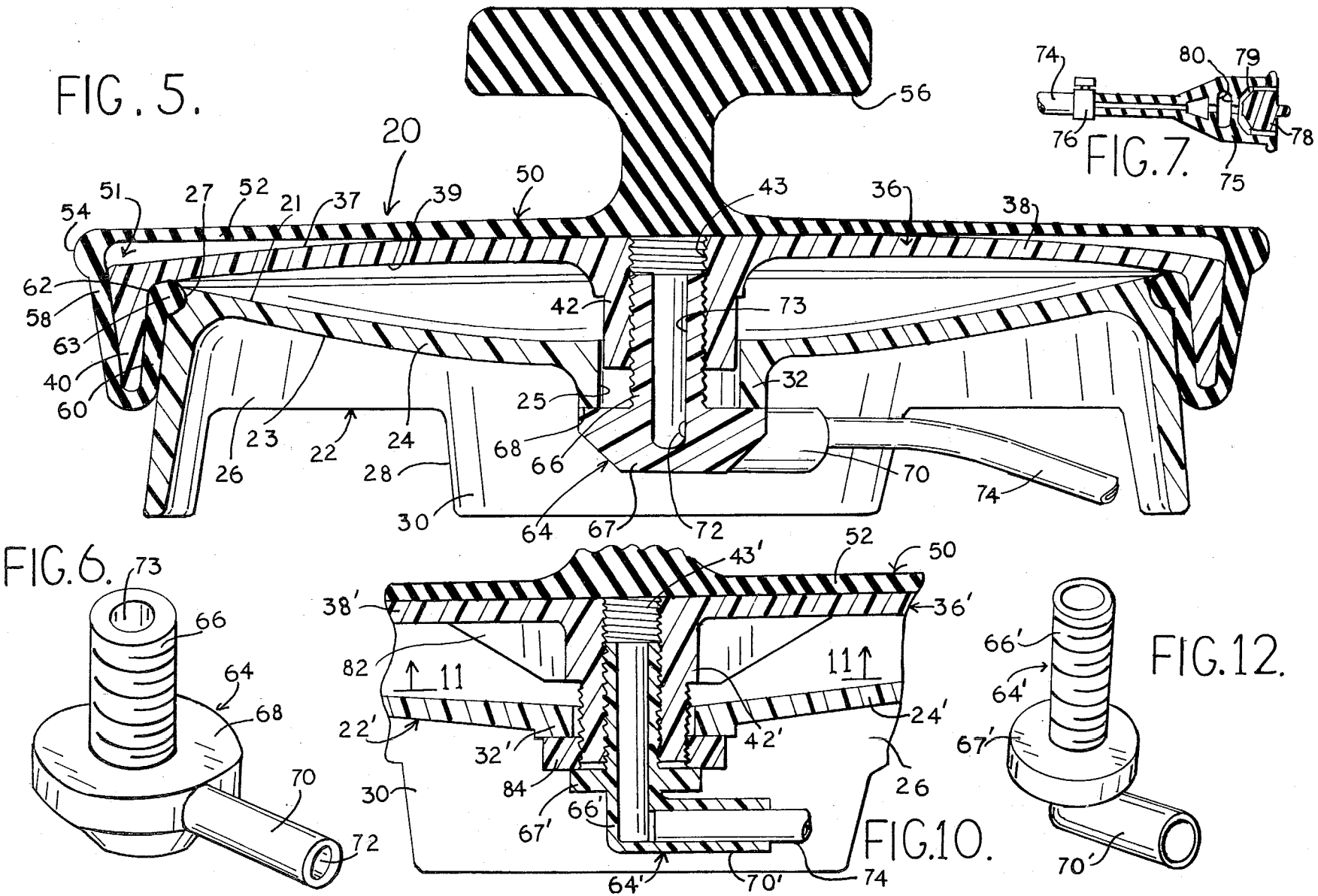
FIG. 5 is an enlarged vertical sectional view taken on line 5—5 of FIG. 3.
FIG. 6 is a perspective view of a fitting employed in the container assembly.
FIG. 7 is an enlarged fragmentary sectional view of a nozzle at the end of a hose taken on line 7—7 of FIG. 1.
FIG. 10 is an enlarged fragmentary sectional view taken on line 10—10 of FIG. 9.
FIG. 12 is a perspective view of a fitting employed in the container assembly of FIGS. 9–11.

Referring first to FIGS. 1–5, there is shown a portable container 20 which has a rigid bottom sealing ring plate 22. This plate serves as a base for the container. It has a top circular wall 24 which is bowed with concave side 21 at the top and convex side 23 underneath. This wall has a central hole 25. Plate 22 also has a conical circumferential side wall 26 which is integral with the periphery of top wall 24. This structure insures that plate 22 is strong and rigid and resists forces applied radially, axially and circumferentially. A circumferential groove 27 is formed in plate 22 at its outer upper rim for a purpose to be described. Side wall 26 has four circumferentially elongated and spaced notches 28 at the bottom defining four curved legs 30 which serve to support the container. A cylindrical flange 32 is formed at the bottom of wall 24 around hole 25.

Pressure plate 36 has a circular curved top wall 38 which is bowed in construction with convex side 37 uppermost and lower concave side 39 spaced from the top of wall 24. Plate 36 has a circumferential depending wall or skirt 40 integral with the periphery of wall 38. A nipple 42 with internally threaded axial bore 43 extends downwardly from the center of wall 38 and fits into flange 32. Wall 26 nests inside wall 40.

Membrane 50 overlays plate 36 and defines an expansible chamber 51 with wall 38. The membrane has a circular generally flat top wall 52 in unstretched condition. Wall 52 tapers in thickness from its center outwardly to a thick reinforcing bead 54 at the rim of the wall; see FIG. 5. Wall 52 is thickest at its center, so that when it is fully stretched by filling chamber 51 with liquid L under pressure (see FIG. 8), it is substantially uniform in thickness throughout and thus resists the pressure equally all around. A massive carrying handle 56 is integrally molded or formed with wall 52 and extends upwardly from its center. A peripheral wall or skirt 58 is integrally molded with top wall 52 and abuts the outer side of wall 40. The membrane has an inwardly turned circumferential wall section 60 concentric with wall or skirt 58 and engaged tightly and snugly between walls 40 and 26. Plate 36 has an inside circumferential concave fillet 62 which receives the outer curved side of a circumferential bead 63 formed at the free inner end of wall section 60. The bead seats snugly in groove 27.

A rigid fitting 64 formed with an externally threaded shank 66 is screwed into nipple 42; see FIGS. 4, 5 and 6. The fitting has a head 67 formed with a flat upper shoulder 68 which bears against the flat bottom of flange 32. When fitting 64 is screwed tightly in place, membrane 50 is held securely with uniform pressure all around since wall section 60 is then locked in place between walls 26 and 40.

Fitting 64 has a nipple 70 integrally formed with head 67 and extending radially outward. The nipple has a bore 72 communicating with bore 73 in shank 66. Bores 72 and 73 communicate with chamber 51 via bore 43 in plate 36. One end of a flexible hose or tube 74 can be securely fitted in bore 72 of nipple 70 for passing liquid L into chamber 51 and for dispensing liquid therefrom. At the outermost end of tube 74 is a nozzle 75; see FIGS. 1 and 7. Nozzle 75 receives a removable plug 78 which has grooves 79 defining channels with the inner side of nozzle 75 to divide a stream of liquid issuing from the container into a finely divided shower or spray. Flexible spaced annular ridges 80 are formed inside the nozzle to engage on a faucet or fixture when the container is being filled with liquid under pressure. Valve 76 to which nozzle 75 is connected can be opened to permit passage of liquid or can be closed to hold liquid under pressure in chamber 51.

To fill the container with liquid L such as water under pressure, plug 78 is removed and nozzle 75 is attached to a faucet of a liquid supply source. When valve 76 is opened membrane 50 will expand as shown in FIG. 8 while liquid flows into the container to fill it. After the container is filled, valve 76 will be closed. The container can then be carried about conveniently by grasping handle 56. When the container is placed on a supporting surface, legs 30 support the container. Tube 74 extends outwardly of the container through one of notches 28 between two legs 30. To dispense liquid L valve 76 will be opened and the liquid will flow under pressure out of the container. Stretched membrane 50 maintains the water flow under pressure until the membrane is fully relaxed as shown in FIGS. 1, 2, and 5.

It will be apparent that the container can readily be disassembled for cleaning by unscrewing fitting 64, lifting plate 36 off of plate 22 and stripping membrane 50 off plate 36. No tools are required for any of these operations. Reassembly is likewise simple and requires no tools. It is performed in reverse order from the disassembly operation. When not in use tube 74 can be coiled conveniently underneath and inside of ring plate 22.

FIGS. 9–12 show parts of a container 20' having a modified construction. Here flange 32' at the center of wall 24' of sealing ring plate 22' is shorter axially but radially wider than flange 32 of plate 22. Central nipple 42' of pressure plate 36' has internal threaded bore 43'. The nipple is internally and externally threaded. Four radial webs 82 are integral with nipple 42' and wall 38' of plate 36' to reinforce the joint of nipple 42' to wall 38'. A nut 84 screws on nipple 42' and bears against the flat bottom of flange 32'. This holds the plates 22' and 36' securely together with wall section 60 of membrane 50 locked in place in the manner shown in FIG. 5. An annular flange 67' is formed on shank 66' of fitting 64'. The shank screws into nipple 42'. Flange 67' bears against nut 84 and serves to lock this nut in place. Nipple 70' is integrally formed with shank 66' and extends radially outward. Flexible hose or tube 74 is secured at one end in nipple 70' for filling container 20' with liquid and for dispensing liquid therefrom. Other parts of container 20' are the same as container 20 described above and are identically numbered.

It will be apparent from the foregoing that significant improvements have been effected over prior self-pressurized containers. These improvements make the container safer and more reliable for general usage. Less parts are required which makes manufacture easier and more economical. Assembly and disassembly are easier and require no tools. Unequal or excessive tension in clamping the membrane to other parts of the container has been substantially eliminated since the membrane is gripped securely circumferentially, and the main gripping force is applied axially. Thus the useful life of the membrane is extended and liquid leakage prevented. Various parts of the container can be made of relatively inexpensive, lightweight molded plastic material and artificial rubber, or they can be made of metal where suitable, all fabricated at relatively low cost by mass production machinery.

While preferred embodiments of the invention have been described and illustrated, it will be apparent that many changes and modifications are possible without departing from the invention which is defined in the appended claims.

What is claimed is:

1. A self-pressurized portable container for liquid, comprising:

a bottom sealing ring plate having:

a first upper circular top wall formed with a central hole, an axially depending cylindrical flange surrounding said central hole, and a depending circumferential first side wall integral with the periphery of said top wall;

a pressure plate having:

a second upper circular top wall, a depending circumferential second side wall integral with the periphery of said second top wall and nesting on the bottom ring plate, and an axially depending nipple axially aligned with said cylindrical flange, and having an axial bore;

a circular elastic membrane having:

a third circular top wall overlaying said pressure plate and defining therewith an expansible chamber for containing liquid under pressure, said bore communicating with said chamber, an axially extending depending skirt integral with the periphery of said third top wall surrounding and abutting said second side wall, and an inwardly turned circumferential wall section concentric with and integral with said skirt engaged between said first and second side walls; and attachment means engaging said nipple and flange and detachably securing said sealing ring plate and pressure plate together to hold said inwardly turned wall section of said membrane in sealing pressure engagement while said top wall of the membrane is free to expand under pressure of liquid filling said chamber.

2. A portable container as defined in claim 1, wherein said bottom sealing ring plate has a circumferential groove formed at the periphery of said first upper circular top wall, and wherein said inwardly turned circumferential wall section of the membrane has a free edge formed with a bead engaging in said groove to hold the circumferential wall section in secure engagement between said sealing ring plate and said pressure plate.

3. A portable container as defined in claim 1, wherein said first upper circular top wall of said sealing ring plate is axially bowed away from said top wall of said pressure plate to strengthen the sealing ring plate, said nipple extending into the central hold in said sealing ring plate for engagement by said attachment means.

4. A portable container as defined in claim 1, wherein said axial bore of said nipple is threaded, and wherein said attachment means comprises a fitting having an externally threaded shank screwed into said bore, and having a head bearing against the flange of said bottom sealing ring plate, said shank having another bore defining a passage communicating with said chamber via said axial bore.

5. A portable container as defined in claim 4, wherein said fitting further comprises another nipple integral with said head and extending radially therefrom for engaging a tube to pass liquid into said chamber via said other bore in said shank and via said axial bore, and to pass said liquid from the chamber through the first named nipple and said fitting.

6. A portable container as defined in claim 5, further comprising a tube engaged with said other nipple for passing liquid into said chamber and out of said chamber through said fitting and the first named nipple.

7. A portable container as defined in claim 1, wherein said nipple of said pressure plate is externally threaded, and wherein said attachment means comprises a threaded nut engaged on said nipple and bearing against said flange of the sealing ring plate.

8. A portable container as defined in claim 7, wherein the axial bore of said nipple is threaded, and further comprising a fitting having an externally threaded shank engaged in said nipple, said shank having another bore defining a passage communicating with said axial bore, said shank having a lateral extension defining another nipple for engaging a tube, said other nipple having a further bore communicating with said other bore and said axial bore to pass liquid into said chamber and to pass liquid from the chamber through said tube, said fitting and the first named nipple.

9. A portable container as defined in claim 8, wherein said fitting has an annular other flange integral with said shank bearing against said nut to lock the same in place.

10. A portable container as defined in claim 9, further comprising a tube engaged with said other nipple for passing liquid into said chamber and out of said chamber through said fitting and the first named nipple, said first top plate of the sealing ring plate being bowed away from said second top wall of said pressure plate to strengthen said sealing ring plate, the first named nipple of said pressure plate extending through the central hole in the sealing ring plate for engagement by said nut.

* * * * *